US008117769B2

(12) United States Patent
Steele

(10) Patent No.: US 8,117,769 B2
(45) Date of Patent: Feb. 21, 2012

(54) CUSHIONED SHOE CONSTRUCTION INCLUDING TOE AND HEEL PLATES

(75) Inventor: George L. Steele, Hot Springs, AR (US)

(73) Assignee: Munro & Company, Inc., Hot Springs, AK (US)

( * ) Notice: Subject to any disclaimer, the term of this patent is extended or adjusted under 35 U.S.C. 154(b) by 720 days.

(21) Appl. No.: 12/284,807

(22) Filed: Sep. 25, 2008

(65) Prior Publication Data

US 2010/0071232 A1 Mar. 25, 2010

(51) Int. Cl.
*A43B 1/10* (2006.01)

(52) U.S. Cl. ..... 36/102; 36/107; 36/25 R; 36/28; 36/31

(58) Field of Classification Search ..... 36/102, 36/107, 103, 25 R, 28, 31, 30 R
See application file for complete search history.

(56) References Cited

U.S. PATENT DOCUMENTS 1,341,498 A * 5/1920 Demarmels et al. ..... 36/33
1,964,406 A * 6/1934 Pellkofer ..... 36/11.5
1,964,705 A * 6/1934 Pellkofer ..... 36/11.5
2,352,532 A * 6/1944 Ghez et al. ..... 36/33
2,590,648 A * 3/1952 Pitz ..... 36/11.5
3,922,801 A * 12/1975 Zente ..... 36/44
4,914,838 A * 4/1990 Ihlenburg ..... 36/114
4,918,838 A * 4/1990 Chang ..... 36/28
4,924,606 A * 5/1990 Montgomery et al. ..... 36/31
5,014,706 A * 5/1991 Philipp ..... 36/140
5,465,507 A * 11/1995 Schumacher et al. ..... 36/30 R
5,786,057 A * 7/1998 Lyden et al. ..... 428/52
5,933,984 A * 8/1999 Carlson et al. ..... 36/43
6,226,896 B1 * 5/2001 Friton ..... 36/28
6,389,712 B1 * 5/2002 Schelling ..... 36/15
7,210,250 B2 * 5/2007 Gallegos ..... 36/44
7,284,341 B2 * 10/2007 Moseley ..... 36/11.5
7,322,129 B2 * 1/2008 Michaeli ..... 36/35 B
7,380,352 B2 * 6/2008 Seiter ..... 36/44
7,444,764 B2 * 11/2008 Mark ..... 36/25 R
7,637,034 B2 * 12/2009 Ailey et al. ..... 36/44
7,637,036 B2 * 12/2009 Sellers et al. ..... 36/103
2002/0083625 A1 * 7/2002 Kobayashi et al. ..... 36/127
2004/0221489 A1 * 11/2004 Hung ..... 36/136
2005/0039350 A1 * 2/2005 Hung ..... 36/107
2006/0053657 A1 * 3/2006 Ailey et al. ..... 36/44
2006/0130365 A1 * 6/2006 Sokolowski et al. ..... 36/35 R
2007/0033834 A1 * 2/2007 Cheskin et al. ..... 36/44
2007/0033835 A1 * 2/2007 Bray ..... 36/44
2008/0022562 A1 * 1/2008 Manis ..... 36/59 R
2009/0019730 A1 * 1/2009 Salminen et al. ..... 36/91
2009/0193683 A1 * 8/2009 Igdari ..... 36/91
2009/0193685 A1 * 8/2009 Wilson ..... 36/102

* cited by examiner

*Primary Examiner* — Darnell Jayne
*Assistant Examiner* — Andrew Roersma
(74) *Attorney, Agent, or Firm* — Lawrence E. Laubscher, Sr.; Lawrence E. Laubscher, Jr.

(57) ABSTRACT

A shoe sole construction includes a sole member formed from a synthetic plastic material having a first durometer value of hardness and including toe, ball, arch, and heel portions. Relatively rigid toe and heel plates are secured to bottom surface of the sole member on opposite sides of a relatively soft flex bar member that extends transversely across the ball portion of the sole member. A plurality of toe cushion members are mounted for independent movement within openings contained in the toe plate, and a stabilizing arch cushion member is mounted in the recess defined in the heel plate. These cushion members have an intermediate durometer value that, during use, permits compression of these cushion members in a footprint pattern.

10 Claims, 3 Drawing Sheets

FIG.1
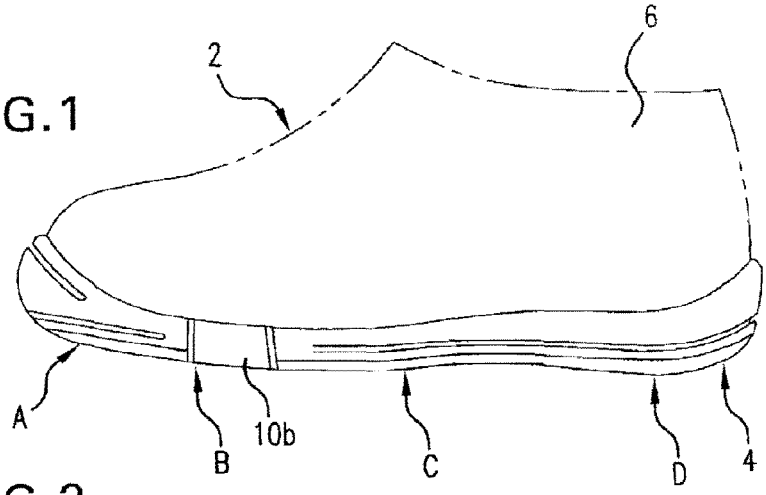
FIG.2
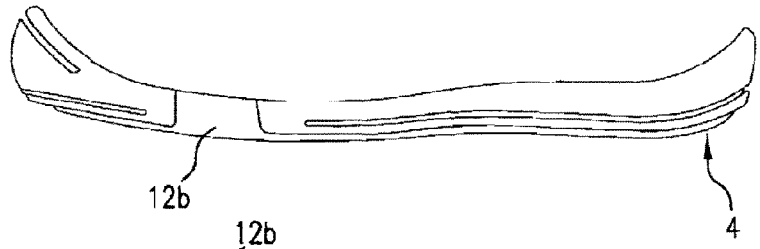
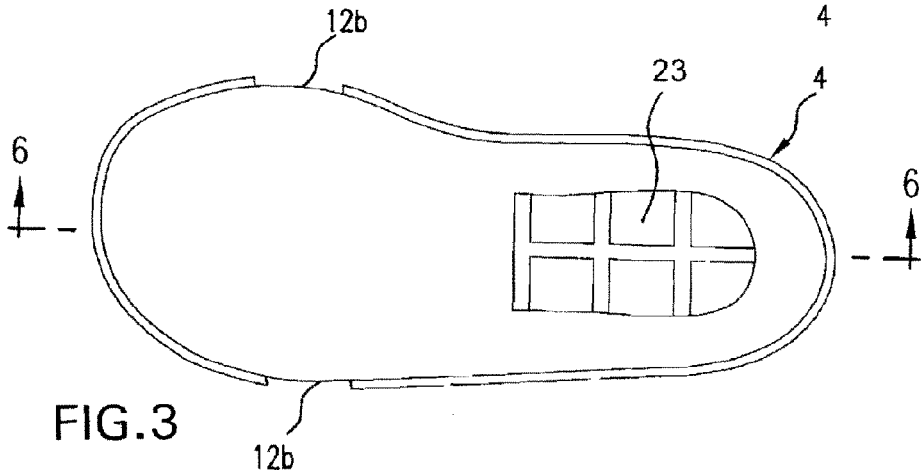
FIG.3

FIG.12
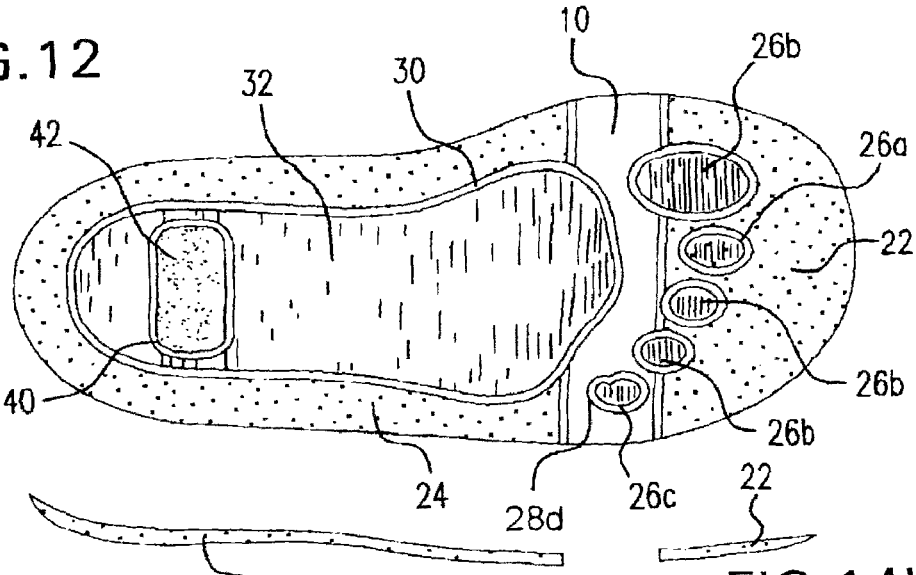
FIG.14a
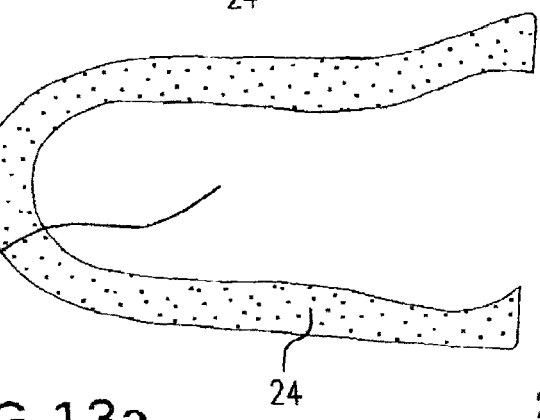
FIG.14b
FIG.13a
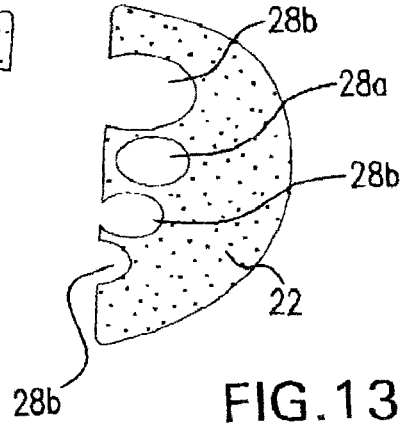
FIG.13b
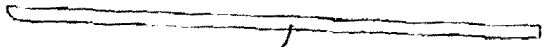
FIG.16a
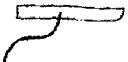
FIG.16b
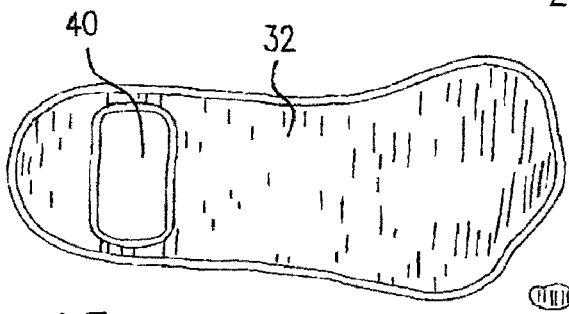
FIG.15a
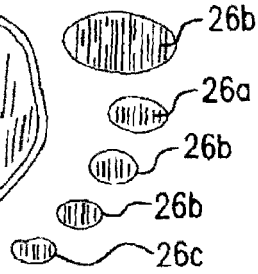
FIG.15b

CUSHIONED SHOE CONSTRUCTION INCLUDING TOE AND HEEL PLATES

BACKGROUND OF THE INVENTION

1. Field of the Invention

A shoe sole construction includes a sole member formed from a synthetic plastic material having a first durometer value of hardness, said sole member including toe, ball, arch, and heel portions. Relatively rigid toe and heel plates are secured to the bottom surface of the sole on opposite sides of a relatively soft flex bar member that extends transversely across the ball portion of the sole member. A plurality of toe cushion members are mounted for independent movement within openings contained in the toe plate, and a stabilizing arch cushion member is mounted in the recess defined in the heel plate. These cushion members are arranged in a footprint pattern and have an intermediate durometer value that permits compression of these cushion members during use.

2. Description of Related Art

Various proposals have been offered in the shoe sole construction art for improving the walking capability of the user, as for example, a young child learning to walk. In the prior Schumacher et al U.S. Pat. No. 5,465,507, which was assigned to the same assignee as the present invention, a sole construction was disclosed including a single rigid stabilizing plate that extended completely across the entire bottom surfaces of the sole from the heel to the toe portions thereof.

The present invention was developed to provide an improved shoe that affords greater flexibility during use without any undesirable side-to-side torque.

SUMMARY OF THE INVENTION

Accordingly, a primary object of the present invention is to provide a sole member formed from a synthetic plastic material having a first durometer value of hardness, including relatively rigid longitudinally-spaced toe and heel plates formed from a synthetic plastic material secured beneath the toe and the arch and heel portions of the sole member. A plurality of toe cushion members are mounted for independent movement within openings contained in the toe plate, and a stabilizing arch cushion member is mounted in the recess defined in the horseshoe-shaped heel plate. These cushion members are arranged in a footprint pattern and have an intermediate durometer value that permits compression of these cushion members during use.

According to another object of the invention, a relatively soft flex bar member extends in a horizontal groove transversely across the ball portion of the sole member between the toe and heel plates, thereby to impart flexibility to the shoe while preventing side-to-side torque movement. The flex bar member preferably includes vertical leg portions that extend upwardly and are secured within corresponding grooves contained in side walls of the sole member. The flex bar may contain openings or recesses for receiving certain portions of the toe and arch cushion members.

BRIEF DESCRIPTION OF THE DRAWINGS

Other objects and advantages of the invention will become apparent from a study of the following specification, when viewed in the light of the accompanying drawing, in which:

FIG. 1 is a side elevation view of a shoe including the improved sole construction of the present invention, the upper portion of the shoe being shown in phantom;

FIGS. 2-5 are side elevation, top plan, front end and rear end views, respectively of the sole member of the shoe of FIG. 1;

FIG. 12 is a bottom view of the shoe of FIG. 1;

FIGS. 13*a* and 13*b* are bottom views of the heel and toe plate members of FIG. 12, respectively;

FIGS. 14*a* and 14*b* are side view of the heel and toe plate members, respectively;

FIGS. 15*a* and 15*b* are bottom views or the arch and toe cushion members, respectively; and FIGS. 16*a* and 16*b* are side elevation views of the arch and toe cushion members, respectively.

DETAILED DESCRIPTION OF THE INVENTION

Referring first more particularly to FIGS. 1-7, the shoe of the present invention includes a sole member 4, and an upper member 6 (shown in phantom). The sole member is formed from a synthetic plastic material having a first degree of hardness, such as styrene-butadiene-styrene with a durometer value of about 45. The sole includes a toe portion A, a ball portion B, an arch portion C, and a heel portion D. The sole includes a generally horizontal bottom wall 4*a*, and vertical toe, heel and side walls 4*b*, 4*c*, and 4*d* which cooperate with said bottom wall to define an open-topped chamber 8. The upper member is adhesively secured or thermally bonded in a conventional manner to the vertical side, front and rear walls of the sole member.

Figure 11:
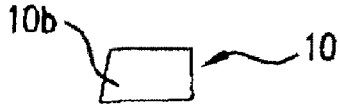
FIG. 11 is an end view of the flex bar of FIG. 9.
Figure 9:
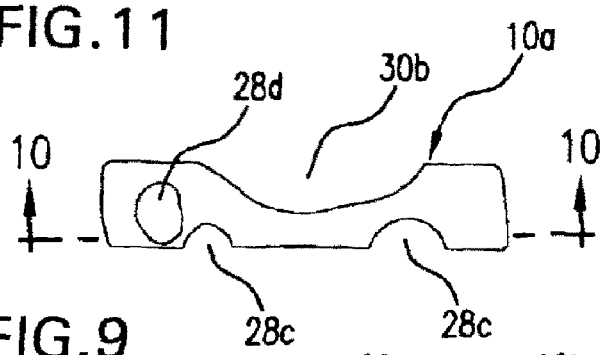
FIG. 9 is a bottom plan view of the flex bar member.
Figure 10:
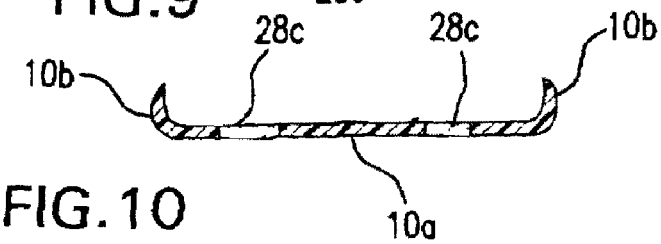
FIG. 10 is a sectional view taken along line 10-10 of FIG. 9.

The ball portion of the sole member 4 contains a groove 12 having a first portion 12*a* that extends continuously transversely across the bottom surface of the sole, and second portions 12*b* that extend upwardly in the outer surfaces of the side walls 4*d*. Secured to the sole member within in the groove 12 is a generally U-shaped flex bar member 10 (FIGS. 9-11) having a horizontal base portion 10*a* that extends within groove portion 12*a* transversely beneath the bottom of the sole member, and a pair of vertical side wall end portions 10*b* that extend upwardly within the groove portions 12*b* contained in the outer surfaces of the side walls of the sole member. The flex bar member 10 is formed from a relatively soft synthetic plastic material having a durometer value (i.e., about 40) that is less than that of the sole member 4.

Referring now to FIG. 12, secured to the bottom surface of the sole member forwardly and rearwardly of the flex member horizontal base portion 10*a* are generally planar toe and heel plates 22 and 24 (FIGS. 13*a*-14*b*) formed from a relatively hard synthetic plastic material having a durometer value (i.e., about 60) that is higher than that of the sole member. A plurality of toe cushion members 26 are provided that are independently secured to the bottom surface of the sole member and extend independently through corresponding openings in the toe and heel plate members and said flex bar member. More particularly, the toe cushion member 26*a* is mounted in the opening 28*a* contained in the toe plate member, and the toe cushion members 26*b* are partially contained in recesses 28*b* provided in the toe plate member, and corresponding recesses 28*c* (FIG. 9) provided in the flex bar member. A further toe cushion member 26*c* is mounted in a toe through opening 28*d* contained in the flex bar member.

An arch cushion recess 30*a* (FIG. 13*a*) is formed in the horseshoe-shaped heel plate member 24 and cooperates with a corresponding recess 30*b* (FIG. 9) formed in the flex bar member 10 to define an opening 30 (FIG. 12) for receiving the stabilizing arch cushion member 32. The toe and arch cushion members are formed from a synthetic plastic material having an intermediate value of durometer hardness (i.e., 50) that is between those of the sole and the toe and heel plate members. These toe and arch cushion members are secured to the sole for compression movement independently of the plate members.

Figure 8:
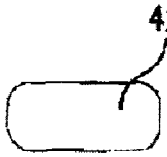
FIG. 8 is a top plan view of the heel cushion member of FIG. 7.
Figure 7:
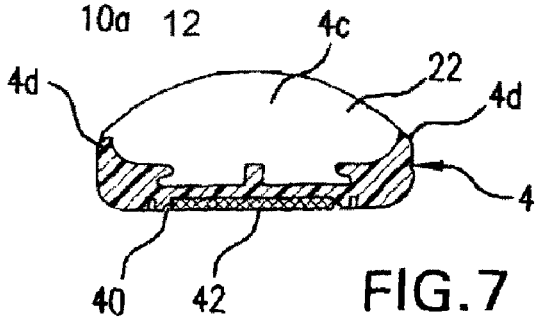
FIG. 7 is a section view taken along line 7-7 of FIG. 6.
Figure 4:
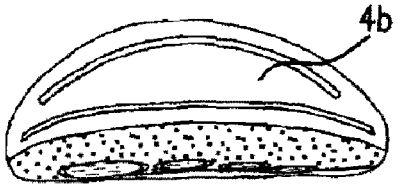
Figure 5:
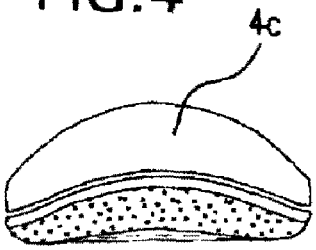

Finally, the stabilizing arch cushion member contains in the heel portion of the sole an opening 40 (FIG. 15*a*) that independently receives the relatively soft heel shock absorber member 42 (FIG. 8) that is secured within the recess 42 contained in the sole bottom surface, which heel shock absorber member has a durometer value equal to that of the flex bar member (i.e., about 40). As shown in FIG. 3, the upper surface of the sole heel portion contains a plurality of heel cavities 23 arranged in a checkerboard pattern at least partially above the heel shock absorber member 42.

Thus, according to the present invention, a four-density outsole is provided that is particularly suitable for use in children's shoes, from beginning walkers up to about five years. The sole member 4 has a relatively soft density (durometer value 45), with very firm density (i.e., durometer value 60) being provided by the heel stabilizer plate 24 in the horseshoe-shaped heel area, and also by the toe plate 22 in the bottom of the toe area forwardly of the flex bar member 10. Medium density (i.e., durometer 50) is provided in the toe and arch stabilizing footprint area of the sole member. In the area of greatest flexibility between the toes and ball of the ball of the foot for natural flexibility exactly where the foot should flex, the flex bar member 10 is relatively soft (with a durometer value of about 40), as does the heel shock-absorbing pad 42. All of the components are formed of a thermal plastic resin, such as styrene-butadiene-styrene. By having toe and heel plates of high durometer rigidity value, a rigid heel support is provided while the child is standing, and the sole will not torque side-to-side. Also, the same rigid support is provided when the child flexes the flex bar area of the sole, and weight is distributed forwardly to the toe member, similarly preventing side-to-side torque. As best shown in FIG. 15*a*, the bottom surfaces of the toe and arch cushion members are preferably embossed with a footprint design. These components mash down a bit when the child walks on the ground. The manufacturer's logo may be placed on the bottom surface of the shock-absorbing heel pad 42.

The toe cushion pads work either separately from each other, or together in the same way as a real foot functions. These components and the arch cushion stabilizing plate have an intermediate hardness, and mash down because of their contact with the ground. The sole member 4 is of softer durometer and works as a foot bed covering the entire surface of the sole between the foot of the child and the more rigid heel and toe members 22 and 24, and the arch cushion stabilizing plate 32. The sole member acts as a shock absorber for the entire foot, and the heel pad creates a shock absorber in the heel area to compress and lessen the shock as the heel of the child strikes the ground.

Figure 6:
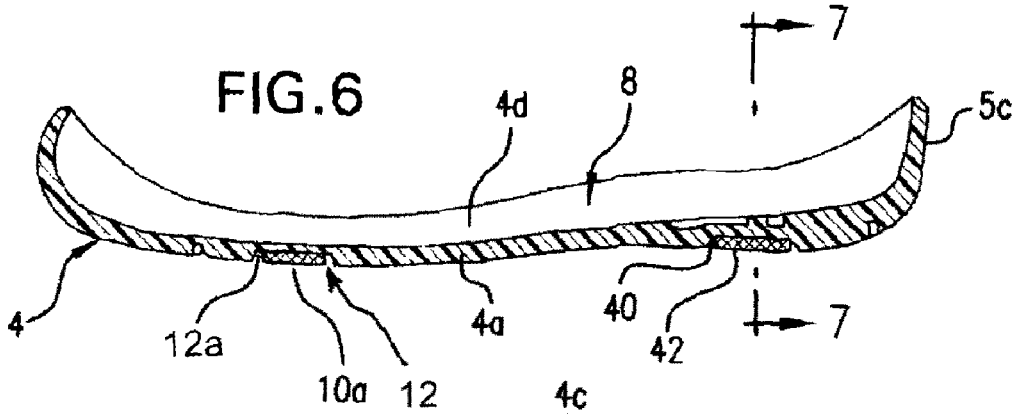
FIG. 6 is a sectional view taken along line 6-6 of FIG. 3.

It should be noted from FIG. 6 that the front wall 4*b* of the sole member 4 extends upwardly to protect the shoe from scuffing in the toe area when the child is crawling, and also to protect the child's toes as well. Similarly, the vertical rear wall 4*c* extends upwardly sufficiently protect the heel of the shoe from scuffing as the child sits on the ground. Therefore, the shoe sole construction of the present invention is more flexible in the areas where it needs to be, and more stable in the area it has to be. Thus, the shoe of the present invention affords the closest possible imitation of a child's bare foot actually walking on the ground while still providing it with the utmost of protection achievable.

While in accordance with the provisions of the Patent Statutes the preferred forms and embodiments of the invention have been illustrated and described, it will be apparent to those skilled in the art that changes may be made without deviating from the invention described above.

What is claimed is:

1. A shoe construction, comprising:

(a) a generally horizontal shoe sole member (4) formed from a flexible synthetic plastic material having a first durometer value of hardness, said sole member including a bottom wall (4*a*) having a generally horizontal bottom surface, and generally vertical toe, heel and side walls (4*b*, 4*c*, 4*d*) extending upwardly from said bottom wall to define an open-topped cavity (8) for supporting a sole portion of a foot of a user, said sole member having toe, ball, arch and heel portions (A, B, C, D);

(b) an upper body member (6) secured to said sole member above and in communication with said cavity;

(c) a toe plate member (22) secured to the bottom surface of said sole member toe portion;

(d) a heel plate member (24) secured to the bottom surface of said sole member heel and arch portions, said toe and heel plate members being formed from a relatively hard synthetic plastic material having a second durometer value of hardness that is greater than said first durometer value, said heel plate being generally horseshoe-shaped and containing a recess (30*a*) adjacent said toe plate;

(e) a plurality of toe cushion members (26) arranged in respective toe openings (28) contained in said toe plate, said toe cushion members being secured to the bottom surface of said sole member toe portion;

(f) an arch cushion stabilizing member (32) arranged in said recess adjacent said toe plate member, said arch cushion member being secured to the bottom surface of said sole arch and heel portions, said toe and arch cushion members being longitudinally spaced relative to said shoe sole member and being formed from a synthetic plastic material having an intermediate third durometer value of hardness that is between said first and second durometer values of hardness, said toe cushion members and said arch cushion members being connected with said sole bottom surface for independent movement relative to said toe and heel plate members, respectively: and (g) a flex bar member (10) formed from a relatively soft synthetic plastic material having a fourth durometer value of hardness that is less than said first durometer value, said flex bar member including:

(1) a horizontal base portion (10*a*) secured to and extending transversely completely across the bottom surface of said sole member ball portion in a space between, and independent of, said toe and heel plate members, said base portion being contained within a corresponding bottom groove (12*a*)contained within the bottom surface of said sole arch portion, and (2) a pair of arm portions (10*b*) that extend upwardly from ends of said base portion in secured relation within corresponding portions of grooves (12*b*) contained in outer surfaces of said sole member side wall portions, respectively.

2. A shoe construction as defined in claim 1, wherein said flex bar member contains a toe cushion recess (28*c*) for independently receiving an adjacent portion of one of said toe cushion members.

3. A shoe construction as defined in claim 2, wherein said flex bar member contains a toe cushion opening (28*d*) for completely receiving one of said toe cushion members.

4. A shoe construction as defined in claim 3, wherein said flex bar member contains an arch cushion recess (30*b*) for independently receiving an adjacent portion of said arch cushion member.

5. A shoe construction as defined in claim 1, wherein an upper surface of said sole heel portion contains a plurality of heel cavities (23) arranged in a checkerboard pattern at least partially above a heel shock absorber member.

6. A shoe construction as defined in claim 5, wherein a front wall (4*b*) of the sole member extends upwardly a sufficient distance to protect the shoe against scuffing.

7. A shoe construction as defined in claim 6, wherein a rear wall (4*c*) of the sole member extends upwardly a sufficient distance to protect the heel portion of the shoe against scuffing.

8. A shoe construction as defined in claim 5, wherein said sole member has a durometer hardness value of about 45, said arch and toe cushion members have a durometer hardness value of about 50, said toe and heel plates have a durometer hardness value of about 60, and said flex bar member and said shock absorber member have a hardness value of about 40.

9. A shoe construction as defined in claim 1, wherein said arch cushion member contains a shock absorber opening (40) adjacent said sole heel portion; and further including:

(h) a relatively soft heel shock absorber member (42) having an upper surface secured to said sole member bottom surface, said heel shock absorber member extending independently within said shock absorber opening and having a lower surface arranged for engagement with a ground surface, said heel shock absorber member having a durometer value of hardness that is generally equal to said fourth durometer value.

10. A shoe construction as defined in claim 1, wherein said toe and arch cushion members have embossed lower surfaces arranged for simultaneous independent engagement with a ground surface.

* * * * *